United States Patent [19]

Gollnick

[11] 4,260,316

[45] Apr. 7, 1981

[54] REFUSE COLLECTION VEHICLE

[75] Inventor: Cyril R. Gollnick, Oshkosh, Wis.

[73] Assignee: Leach Company, Oshkosh, Wis.

[21] Appl. No.: 38,345

[22] Filed: May 11, 1979

[51] Int. Cl.[3] ..... B65F 3/20

[52] U.S. Cl. ..... 414/501; 414/517; 414/525 R

[58] Field of Search ..... 414/501, 492, 493, 517, 414/525 R, 512, 509

[56] References Cited

U.S. PATENT DOCUMENTS

| | | | |
|---|---|---|---|
| 3,232,463 | 2/1966 | Weir | 414/525 R |
| 3,819,071 | 6/1974 | Liberman | 414/517 |
| 3,865,260 | 2/1975 | Wieschel et al. | 414/517 |
| 3,901,394 | 8/1975 | Bowles | 414/525 |

*Primary Examiner*—James B. Marbert

*Attorney, Agent, or Firm*—Lockwood, Dewey, Alex & Cummings

[57] ABSTRACT

A side-loading refuse collection vehicle includes a refuse storage body with a collection hopper at one end of the body opening through a side thereof for loading refuse. A hopper plate movable through the hopper and a sweep panel movable across the hopper plate cooperate to remove refuse from the hopper and deposit it through an opening in a packer plate movable fore-and-aft in the refuse storage body. The sweep panel may be carried by the packer plate and both may have deflecting surface portions, to cooperate as a unit in balanced packing of refuse within the refuse storage body.

37 Claims, 5 Drawing Figures

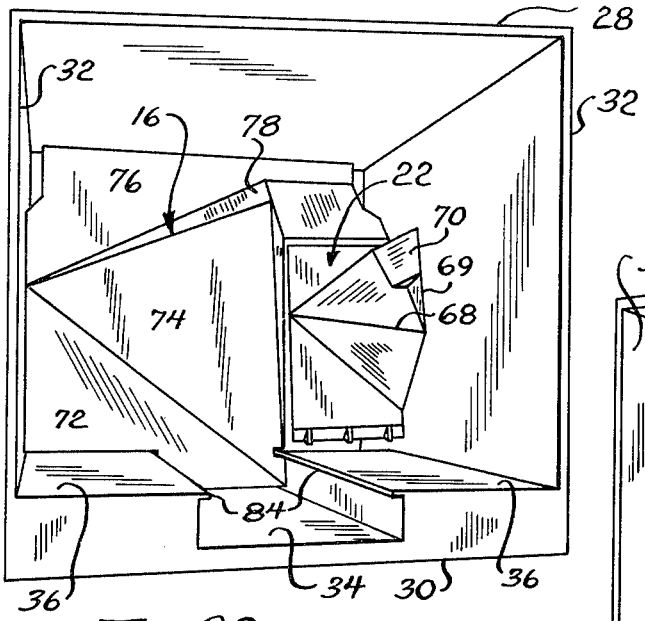
Fig. 3
Fig. 4
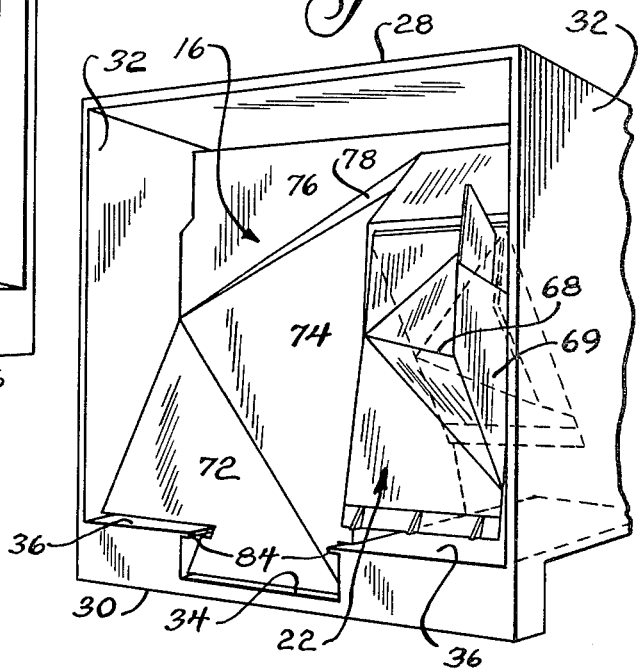
Fig. 5
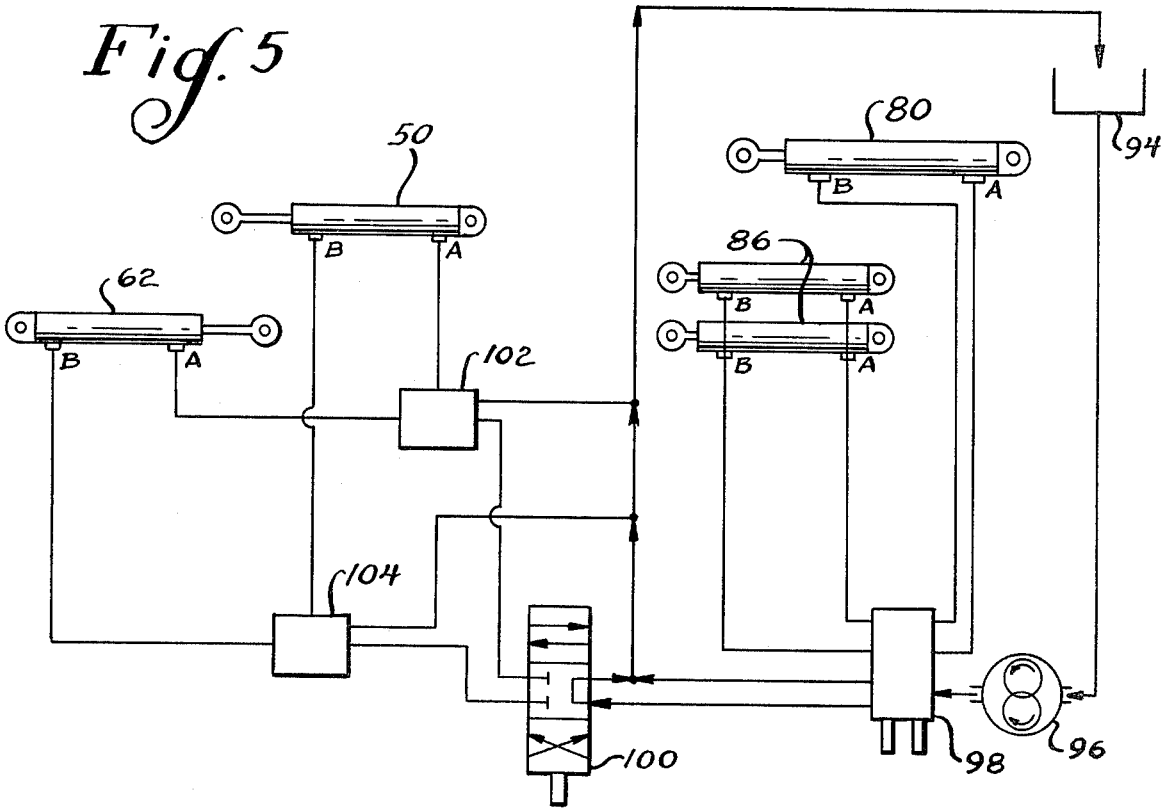

REFUSE COLLECTION VEHICLE

The present invention generally relates to refuse collection vehicles, and more specifically, to side-loading collection vehicles having a refuse storage body and a packer plate movable within the body to compress the stored refuse.

Refuse collection vehicles are available in a variety of sizes and configurations. A typical vehicle may have a refuse storage body, with a loading hopper at the rear end of the body. Refuse loaded into the hopper is scooped or moved forwardly into the storage body, by a hopper blade, where the refuse is crushed and compacted by a packer plate.

It is also known to have refuse collection vehicles that are side-loading. Refuse is loaded through the side of a storage body and compacted therewithin. Because the loading opening in the side of the body is usually on the same side of the vehicle as the driver, the driver does not have to run to the back of the truck for dumping refuse into a collection hopper, resulting in a more efficient loading operation.

On the other hand, side-loading vehicles typically have relatively small side openings, making loading inconvenient, and due to the nature of a side-loader, there is a tendency for refuse to collect on the side through which it is loaded, creating an unbalanced load. Finally, in all collection vehicles, not just side loaders, operator safety is becoming an increasingly important consideration.

Accordingly, it is a general object of the present invention to provide an improved side-loading refuse collection vehicle.

It is a more specific object of the present invention to provide a side-loading collection vehicle which compresses and packs refuse in the storage body in a balanced manner.

It is a further object of the present invention to provide a side-loading vehicle which is easy to use without danger to the operator from moving parts or the like.

It is a further object of the present invention to provide a side-loading collection vehicle which has a large loading area but which does not allow spillage of the refuse from the loading area.

These and other objects of the present invention are set forth in the following detailed description and the attached drawings, of which:

FIG. 3 is a perspective view looking into the rear end of the vehicle of FIG. 1.

FIG. 4 is a perspective view looking into the rear of the vehicle of FIG. 1, with the components in a more rearward position than in FIG. 3.

FIG. 5 is a schematic diagram of the hydraulic control system employed in the vehicle of FIG. 1.

Figure 1:
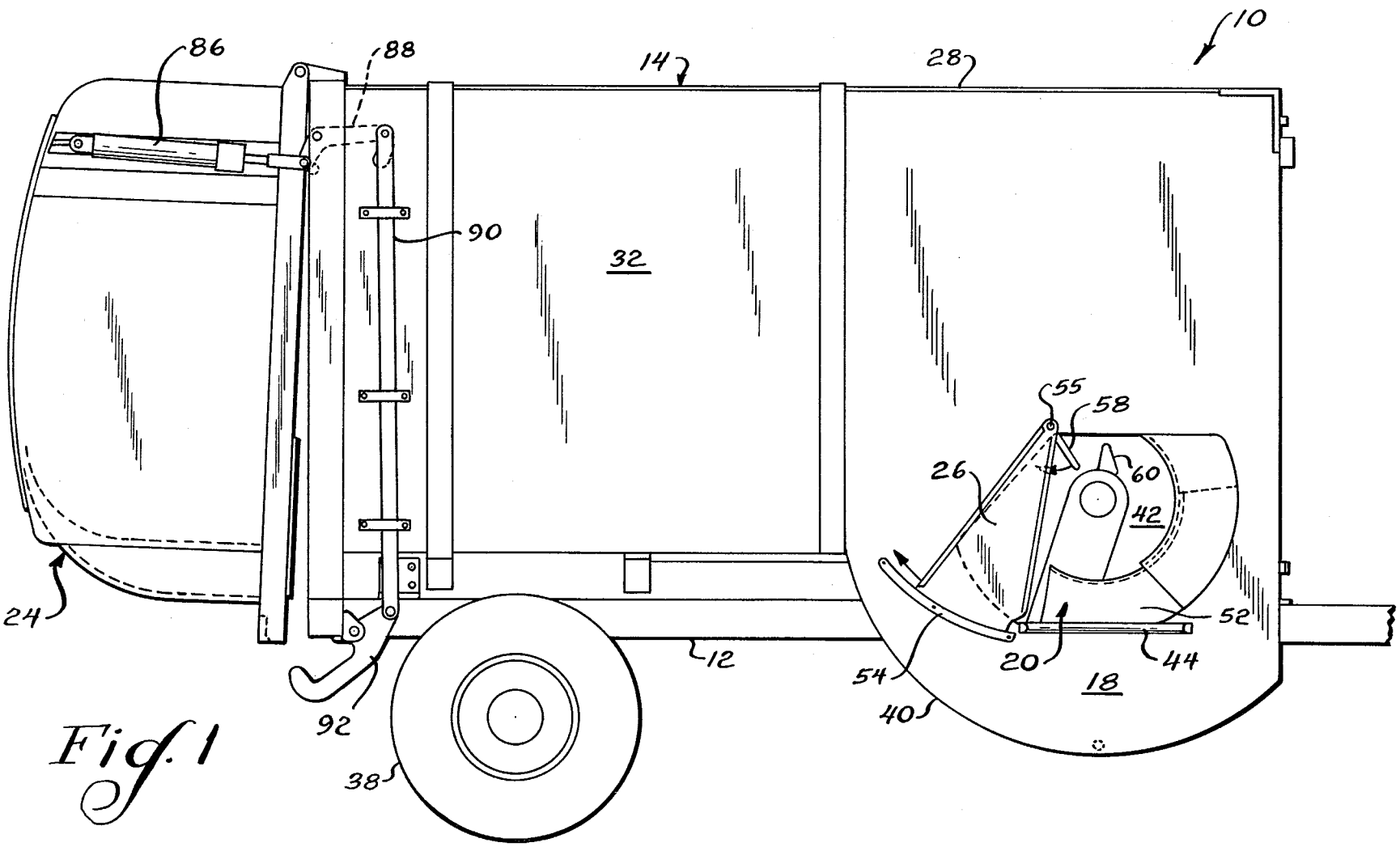
FIG. 1 is a side elevational view, partially removed, of a refuse collection vehicle embodying the present invention.

The present invention is generally embodied in a refuse collection vehicle or truck, designated generally at 10. The passenger cab of the vehicle is available from commercial sources in a variety of sizes and shapes depending on the particular application intended and is not shown in the drawings. The vehicle includes frame

12 supporting a large, elongated storage body 14 into which refuse is accumulated. A packer plate, generally at 16 is movable fore-and-aft within the body to compress and pack the refuse collected so that more may be accumulated without the need for repeated emptying.

Figure 2:
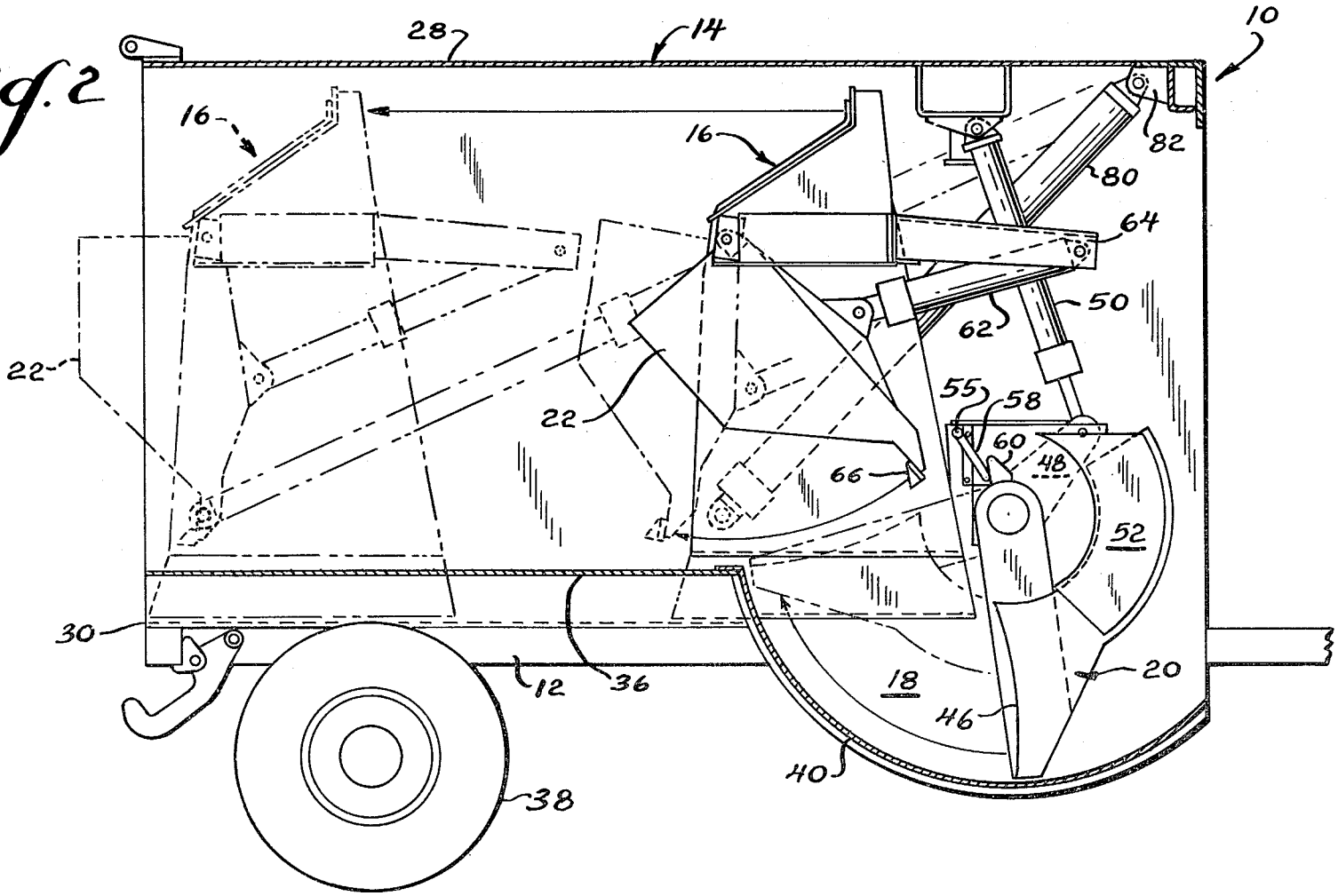
FIG. 2 is a side elevational view of the vehicle of FIG. 1, with the side panel of the refuse storage body removed, and with alternate positions of the components illustrated in phantom.

In accordance with the present invention, a collection hopper 18 is provided at the front end of a refuse storage body 14 and opens through a large access opening in the side of the body for loading refuse into the hopper. As best seen in FIG. 2, a hopper plate 20 is movable along a path through the hopper to lift and remove the refuse therefrom. A sweep panel 22 is movable along a complementary path to sweep the refuse from the hopper plate through opening means (See FIGS. 3 and 4) in the packer plate 16 for accumulation between the packer plate and the rear end of the body. The sweep panel 22 may be carried by the packer plate 16 and positionable to close the opening therein to provide a single movable unit which spans the refuse storage body for compressing refuse between the packer plate and a bulbous tailgate 24 closing the rear end of the body 14 and providing increased storage capacity. Both the packer plate and sweep panel may also include deflection surfaces for moving the refuse toward the closed side of the truck and preventing unbalanced accumulation on the loading side of the body. To prevent spillage of refuse from the enlarged access or loading opening in the side of the body 14 when the hopper plate 20 is activated to scoop the refuse from the hopper, a spill shield 26 is provided adjacent the loading opening and released upon actuation of the hopper plate to cover the portion of that opening through which refuse may spill. As a safety measure, the spill shield may also help block inadvertent human contact with moving parts of the collection apparatus.

Turning now to a more detailed description of the preferred embodiment of the present invention, which is shown in the attached drawings for the purpose of illustration and not limitation, the refuse collection vehicle embodying the present invention is shown in a vertical plan view in FIG. 1. As noted earlier, the cab for the vehicle or truck may be of a variety of configurations, and is not crucial to the present invention. For example, the cab may be an ordinary truck cab with a bench seat, or the cab may include a standup driving cubicle similar to that used on milk delivery trucks or vans. In the preferred refuse collection vehicle, the refuse storage body 14 is mounted behind the cab, atop the truck frame 12. As seen in FIGS. 1–4, the storage body is elongated and substantially rectangular in cross section, with a top wall 28, bottom wall 30 and a pair of sidewalls 32 extending therebetween. Referring particularly to FIGS. 3 and 4, the bottom wall has a center channel 34 extending fore-and-aft within the body, and defining raised surface portions 36 on either side thereof, for clearance with the rear wheels 38 mounted below the frame. At the front of the body, one of the raised surface portions 36 terminates in a semi-circular trough defined by a curved bottom wall 40, which forms the collection hopper 18. As best seen in FIG. 1, the sidewall 32 of the body has a loading opening 42 above the hopper. The lower edge of the opening has a reinforcing strip 44 against which containers or cans of refuse can be braced during loading of the collection hopper through the opening in the sidewall. The collection hopper 18 does not extend the full width of the body, but rather is approximately the same width as the raised surface portion 36 or the sweep panel 22.

For removing refuse loaded into the hopper 18, the hopper plate 20 is pivotally mounted above the hopper to move in an arc that closely conforms to the curved bottom wall 40 of the hopper. The hopper plate 20 has a concave blade 46 which extends down into the hopper at its free end and is pivotally mounted to a support frame, not shown, at its other end. The blade has a curved concave surface for scooping and lifting the refuse from the hopper. The space between the end of the blade and the bottom wall 40 of the hopper 18 is sufficiently small to prevent any significant amount of refuse from remaining in the hopper.

For moving the hopper plate 20 through an arc to lift out rubbish from the hopper 18, the plate includes a lever arm 48 extending radially toward the front of the vehicle, and attached at the end to a hydraulic cylinder 50. The hydraulic cylinder is mounted at its other end to the top wall of the refuse body 14, so that upon extension of the hydraulic cylinder, the hopper plate is pivoted from a position adjacent the front of the hopper to a rearwardly pointed, almost horizontal position as shown in phantom in FIG. 2, with the refuse scooped out and lifted by the concave blade 46 of the hopper plate. To guard against accidental loading of the hopper during movement of the hopper plate, the plate has a side panel 52 which blocks the rim of the hopper loading opening 42 during movement of the hopper plate. The side panel is shown in FIG. 1 in the blocking position.

In the illustrated collection vehicle, the loading opening 42 in the sidewall of the storage body is oversized to make it easier for the workmen to dump refuse into the hopper 18. To prevent the refuse from spilling from the enlarged opening when the hopper plate pivots through the hopper to scoop up the refuse, the spill shield 26 automatically moves to cover a portion of the opening to prevent the refuse from spilling out. The spill shield is a pie-shaped metal plate mounted on the outside of the sidewall of the storage body. The shield is pivotally mounted at its upper, pointed end and the lower end is slideably positioned in a guide 54 mounted on the side of the body. A connecting rod 55 extends from the pivoting end of the shield through the sidewall of the body to position adjacent the hinged connection of the hopper plate. The inside end of the rod includes a radially extending pivot arm 58 positioned to engage a cam or ear 60 mounted on the hopper plate 20. As the hopper plate moves to its retracted position, the cam 60 engages the pivot arm 58, turning the rod and pivoting the spill shield clockwise, away from the loading opening 42. When the hopper plate is activated to scoop up the refuse in the hopper, the ear releases the pivot arm 58, allowing the spill shield to move downwardly, counterclockwise to cover the left edge portion of the opening 42. The spill shield may be spring-biased into the spill-proof position, but gravitational force on the spill sheild will normally cause it to move to the lowermost position.

After the refuse is lifted out of the hopper 18 by the hopper plate 20, it is swept into the storage body 14, through an opening in the packer plate, by the sweep panel 22. The opening in the packer plate is substantially rectangular and is in direct communication with the hopper 18. The sweep panel 22 is hinged at the top of the opening in the packer plate, and swings along an arc which brings the lower edge of the sweep panel closely adjacent to the position of the hopper plate 20 when refuse has been lifted and scooped out of the hopper. In fact, the arc that the lower edge of the sweep panel swings in, corresponds closely within the concave curvature of the hopper plate blade 46, so as to clean the refuse from the blade.

The sweep panel 22 is pivoted by a hydraulic cylinder 62 located on the front side of the packer plate. One end of the cylinder is hinged to the front side of the sweep panel. The other end of the cylinder is hinged to the free end of a rigid cantilever support arm 64 which is welded to the packer plate and extends forwardly, toward the front of the storage body 14. Thus, when the hydraulic cylinder 62 is retracted, the sweep panel is drawn toward the front of the vehicle, as shown in solid lines in FIG. 2. After refuse is scooped out of the hopper by the hopper plate 20, the hydraulic cylinder 62 is activated to move the sweep panel down over the blade 46 of the hopper plate, to sweep the refuse off the blade and through the opening in the packer plate, for example, to the position shown in phantom in FIG. 2. Teeth 66 may also be provided along the bottom edge of the sweep panel to aid in tearing and sweeping the refuse into the storage body.

Because this is a side-loading refuse vehicle, care must be taken to insure that the refuse accumulated in the storage body 14 is not out of balance. Looking at FIGS. 3 and 4, the refuse contacting surfaces of the sweep panel 22 are shaped to deflect the refuse or garbage toward the closed side of the body. In particular, the sweep panel includes a pyramidal projection 68 pointing toward the rear end of the storage body. As particularly seen in FIG. 4, one side 69 of the pyramid is adjacent to and parallel to the sidewall of the body. The other two sides of the pyramid slope away from that sidewall to direct or deflect refuse toward the opposite, closed sidewall. The illustrated sweep panel further includes an additional, upper deflector surface portion 70 to move the refuse away from the open side of the body.

After sufficient refuse is collected in the refuse storage body 14 behind the packer plate 16, the packer plate is forced rearwardly in the body, to compress and compact the refuse that has been collected therewithin. The particular shape of the packer plate in the present invention is best viewed in FIGS. 3 and 4. Including the opening in which the sweep panel 22 is mounted, the packer plate spans the entire width and height of the storage bin. As with the sweep panel, the packer plate includes angled surfaces for deflecting the refuse toward the closed side of the body. The major portion of the packer plate includes four surface panels, a lower triangular panel 72, which is at substantially right angles to the closed sidewall but sloped rearwardly to lift refuse, a middle triangular panel 74 which is vertical but slants at a deflecting acute angle with respect to the closed sidewall to move refuse theretoward, an uppermost vertical panel 76 extending up to the top wall of the body, and a narrow triangular panel 78 connecting the vertical panel 76 and the middle triangular panel 74. This construction both lifts and sidewardly shifts the refuse accumulated in the storage body.

The packer plate 16 is moved back and forth within the storage body 14 by a hydraulic cylinder 80 pivotally mounted at one end to a bracket 82 at the upper front corner of the storage body and, at the other end, near the bottom of the packer plate. Accordingly, when the cylinder 80 is retracted, the packer plate is pulled to the front of the storage body, and when the cylinder is extended, the packer plate is pushed to the rear of the body, either to compress the refuse stored therein or to push the refuse out the back end of the body. It should be noted that the sweep panel is carried by the packer plate, and, in its neutral position, closes the opening in the packer plate through which refuse enters the storage body. In this way, the packer plate and sweep panel form a continuous unit which spans the body and is movable fore-and-aft within the body. The aft position of the packer plate and sweep panel are shown in phantom in FIG. 2, at the rear of the body. Referring back to FIGS. 3 and 4, the bottom wall of the body has a pair of facing guides or runners 84 extending laterally from the raised surface positions 36. The packer plate is slotted to receive these longitudinal guides, which prevent the packer plate from excessive raising or shifting during the packing operation.

The rear end of the storage body 14 is closed by the hollow, bulbous tailgate 24. When closed against the body, this tailgate adds significantly to the storage capacity for waste material. The tailgate is hinged at the rear edge of the top wall 28, so as to open by pivoting upwardly. This is accomplished by hydraulic cylinders 86, one on each side of the tailgate, which have one end mounted to the tailgate and the other end mounted on the body sidewall. Thus, when the cylinders are extended, the tailgate is pushed outwardly and upwardly, opening the refuse storage body for dumping.

The hydraulic cylinders 86 for raising the tailgate 24 also cooperate with a latching mechanism mounted along each side of the storage body 14 which locks the tailgate in the closed position. Each hydraulic cylinder is connected to one end of a pivot arm 88 on the side of the body. The other end of the pivot arm is hingedly connected to a sliding vertical link 90. The link terminates at one end of a pivoting hook 92. When the hydraulic cylinder is extended, it rotates the pivot arm 88, raising the sliding link 90 which, in turn, rotates the hook 92 to a released position, thereby allowing the tailgate to swing outwardly and upwardly. When the tailgate is closed, contraction of the hydraulic cylinder 86 allows the tailgate to close, and further retraction of the cylinder, acting through the pivot arm, link and hook, move the hook to grip behind a lower flange on the tailgate.

The hydraulic system for operating the refuse vehicle described above is shown in FIG. 5. It includes a reservoir 94 for the hydraulic fluid, which flows through a positive displacement pump 96 for pressurization. The hydraulic fluid normally passes through a double spool valve 98 to a main control valve 100 which controls the sequence and relative movement of the hopper plate and sweep panel. The main operating valve 100 is a three-position valve with two operating positions and a neutral position. Once moved to a first position by a hand lever (not shown), the valve automatically sequences, by a combination of mechanical and hydraulic pressure-sensitive means, from a first operative position to a second operative position and back to the neutral position. This valve is known as the Leach Main Operating Valve and is commercially available from the Leach Company, P.O. Box 2608, Oshkosh, Wis. 54901. Because it is known in the art, the details of its construction will not be described here.

The sequence of operation of the vehicle and hydraulic system may be best seen by viewing FIGS. 2 and 5 at the same time. The main operating valve 100 is first operated by shoving the valve plunger forward. This directs the flow of hydraulic fluid to a first pressure-sensitive sequence valve 102. The hydraulic oil flows normally through the sequence valve 102 to port A of the hydraulic cylinder 62 for the sweep plate, causing a retraction of the cylinder which pulls the sweep plate toward the front of the storage body 14.

After the sweep plate cylinder 62 is retracted, the pressure in the line to port A of the sweep cylinder builds up sufficiently to cause automatic switching of the oil flow to port A of the hopper cylinder 50. The hopper cylinder is normally in a retracted position, and application of hydraulic fluid through port A causes the hydraulic cylinder 50 for the hopper plate to extend, thereby pivoting the hopper plate through the hopper, scooping out any refuse.

When the hopper plate cylinder 50 is fully extended, the pressure of the hydraulic fluid builds up, and is reflected back through the sequence valve 102 to the main control valve 100. When this pressure exceeds a selected limit, the main control valve automatically switches to the second operative position, in which hydraulic fluid is directed to a second pressure-sensitive sequence valve 104. In the normal position, the oil flow passes through sequence valve 104 to port B of hydraulic cylinder 62 which moves the sweep panel. This causes an extension of the sweep panel cylinder, which moves the sweep panel through an arc across the face of the hopper blade, shoving and sweeping the refuse through the opening in the packer plate 22 and into the back end of the storage body.

When the sweep plate cylinder 62 is fully extended, pressure builds up until the sequence valve 104 switches the hydraulic fluid to port B of the hopper plate cylinder 50. This causes a retraction of the cylinder, which pivots the hopper plate back to its neutral position toward the front of the truck. When the hopper plate cylinder is fully retracted, the hydraulic pressure again builds up, and is reflected back through the sequence valve 104 to the main operating valve 100 which automatically moves to the neutral position, and the cycle is complete. It should be noted that in the neutral position, the sweep panel closes the opening in the packer plate and the hopper plate is in the most forward position, ready for loading.

The double-spool valve 98 is used to control actuation of the hydraulic cylinders 80 for the packer plate and 86 for the tailgate. Each spool has two positions, to feed hydraulic fluid to one of the two ports in the selected hydraulic cylinder. The spool controlling a given cylinder is merely a matter of choice. The spool controlling the packer plate cylinder 80 may be moved to one position to pressurize port A, causing extension of the hydraulic cylinder, which forces the packer plate rearwardly to compact the refuse stored within the body or to shove the refuse out the rear end. Because the sweep panel is carried by the packer plate, normally in a position closing the opening therein, it moves along as a part of the plate to compress or move the refuse in the body. Reversal of the selected spool allows oil to flow to port B of the packer plate cylinder, causing a retraction of the cylinder and movement of the packer plate to the front end of the storage body. Similarly, the other spool of the valve 98 controls the flow of oil to both of the ports for the tailgate hydraulic cylinders 86, causing the tailgate to open by application of the hydraulic fluid to ports A of the cylinders causing them to extend and push the tailgate outwardly and upwardly. The tailgate may be closed and located by reversing the valve to apply pressure to ports B of the hydraulic cylinders which close the tailgate and lock the pivoting hooks around a flange of the tailgate.

In summary, it may be seen that in accordance with the present invention, an improved side-loading refuse collection vehicle is provided. Refuse may be loaded through a wide opening in the side of the vehicle but spillage is prevented by a shield which automatically closes a portion of the opening when a hopper blade is activated to scoop out the refuse dumped into the collection hopper. After refuse is scooped out of the hopper, a sweep panel is automatically sequenced to sweep the refuse from the hopper plate through an opening in a main packer plate and into the storage body of the vehicle. The adjacent moving parts are shielded from accidental contact with the workmen involved. The sweep panel is carried on the packer plate and, in the neutral position actually functions as part of the packer plate for compacting refuse or shoving the refuse through the back end of the storage body. Both packer plate and sweep cylinder are shaped to provide a balanced refuse load even though refuse is admitted through only one side of the storage body. A hollow, bulbous tailgate closes the storage body to provide increased storage capacity, and includes a pivoting lock system for raising and lowering, releasing and locking the tailgate. The present invention has been described in terms of the preferred embodiment for the purpose of illustration and not limitation, and it is intended that the present invention, as defined in the following claims, cover those equivalent structures, some of which may be obvious upon reading this description and others of which may be obvious only after some study.

What is claimed is:

1. A refuse collection vehicle comprising a storage body, a packer plate movable fore-and-aft in said body; a collection hopper at one end of said body and opening through the side thereof; a hopper plate cooperatively associated with said hopper and movable along a path between a retracted position and an extended position to lift and remove refuse from said hopper; opening means in said packer plate communicating with said hopper and a sweep panel carried by said packer plate and movable along a path between a retracted position forward of said packer plate and an extended position adjacent said packer plate opening means, the path of said sweep panel passing adjacent said extended hopper plate position to sweep refuse from said hopper plate and through said opening means, said packer plate and sweep panel together comprising a unit substantially spanning said body and movable together fore-and-aft within said body for compressing or discharging refuse contained therewithin.

2. A refuse collection vehicle in accordance with claim 1 wherein said hopper includes a refuse receptacle comprising a curved bottom wall portion, said hopper plate being pivotally mounted above said receptacle to scoop out and lift refuse from the receptacle.

3. A refuse collection vehicle in accordance with claim 1 further comprising a spill sheild carried by said body adjacent the hopper opening in the side of the body and cooperatively associated with said hopper plate to close a portion of said hopper opening to prevent spillage when said hopper plate is moved to said extended position.

4. A refuse collection vehicle in accordance with claim 3 wherein said hopper plate is pivotally mounted above the receptacle, and includes cam means, said spill shield also being pivotally mounted and further comprising a lever engageable with said cam means to pivot said spill shield to open and close a portion of said hopper opening when said hopper plate is pivoted.

5. A refuse collection vehicle in accordance with claim 1 wherein said hopper plate spans said hopper and comprises a concave blade for moving and lifting the refuse.

6. A refuse collection vehicle in accordance with claim 2 further comprising a hydraulic cylinder carried at one end by said body and at the other end by said hopper plate to pivot said hopper plate upon energizing of said cylinder.

7. A refuse collection vehicle in accordance with claim 6 wherein said hopper plate further comprises a lever arm, said other end of said hydraulic cylinder being carried on said lever arm.

8. A refuse collection vehicle in accordance with claim 1 wherein said sweep panel is carried by said packer plate and pivotally mounted adjacent said opening means in said packer plate.

9. A refuse collection vehicle in accordance with claim 8 further comprising a rigid support arm carried by said packer plate and a hydraulic cylinder carried at one end by said support arm and at the other end by said sweep panel.

10. A refuse collection vehicle in accordance with claim 1 wherein said sweep panel is pivotally mounted on said packer plate at the top of said opening means.

11. A refuse collection vehicle in accordance with claim 1 wherein said sweep panel is pivotally mounted on said packer plate adjacent the top of said opening means, the path of movement of said sweep panel comprising an arc, said hopper including a refuse receptacle comprising a curved bottom wall portion, said hopper plate being pivotally mounted thereabove and movable to scoop out and lift refuse from the receptacle to a position adjacent the arc of said sweep panel.

12. A refuse collection vehicle in accordance with claim 11 wherein said hopper plate has a concave refuse-engaging surface matching the arc of said sweep panel, said sweep panel including a plurality of teeth at its bottom edge to clean said hopper plate of refuse.

13. A refuse collection vehicle in accordance with claim 1 wherein said sweep panel includes a surface portion sloping toward the closed side of said body to move refuse toward said closed side.

14. A refuse collection vehicle in accordance with claim 13 wherein said surface portion comprises a pyramidal projection from said sweep panel, one wall of said projection being substantially co-planar and adjacent said open body wall.

15. A refuse collection vehicle in accordance with claim 13 further comprising a plurality of non-parallel surfaces sloping toward said closed side.

16. A refuse collection vehicle in accordance with claim 1 wherein said packer plate includes at least one refuse-deflecting wall surface sloping toward the closed side of said body to push refuse toward said closed side.

17. A refuse collection vehicle in accordance with claim 16 comprising a plurality of wall surfaces which are planar and non-parallel and slope at an acute angle with respect to said closed side.

18. A refuse collection vehicle in accordance with claim 1 further comprising a hydraulic cylinder, one end of said cylinder being carried at one end of said body and the other end of said cylinder being carried by said packer plate.

19. A refuse collection vehicle in accordance with claim 1 wherein said body includes at least one runner extending fore-and-aft, said packer plate including a guide slot through which said runner passes.

20. A refuse collection vehicle in accordance with claim 1 wherein said body comprises a recessed channel running fore-and-aft in the bottom thereof, said packer plate including a depending portion residing in said channel, said channel having a runner along each side thereof, said packer plate having a pair of guide slots in which said runners are disposed.

21. A refuse collection vehicle in accordance with claim 1 further comprising a bulbous tailgate closing one end of said body.

22. A refuse collection vehicle in accordance with claim 21 wherein said tailgate is hinged to said body at the top thereof, and further comprising at least one hydraulic cylinder carried at one end by said tailgate and at the other end by one end of a pivot arm pivotally mounted on the body, one end of a sliding link hingedly connected to the other end of said pivot arm, a second pivot arm mounted on said body and having one end attached to the other end of said sliding link and the other end of said second arm comprising a latch for engaging said tailgate, whereby extension of said hydraulic cylinder pivots said latch to unlock said tailgate and lifts said tailgate.

23. A refuse collection vehicle comprising a storage body, a packer plate spanning said body and being slidably movable fore-and-aft therewithin, a collection hopper at one end of said body opening means in said packer plate communicating with said hopper, means for moving refuse from said hopper to adjacent said opening means, sweep panel means carried by said packer plate and movable between a retracted position spaced from said opening means to a position adjacent said opening means to sweep the refuse into the body, said packer plate and sweep panel being movable as a unit fore-and-aft in said body to compact or compress refuse therein.

24. A refuse collection vehicle in accordance with claim 23 wherein said sweep panel is normally adjacent said opening means, said packer plate and sweep panel being movable as a unit fore-and-aft in said bin to compact or compress refuse therein.

25. A refuse collection vehicle comprising a storage body, a packer plate spanning said body and being slidably movable fore-and-aft therewithin, a first hydraulic cylinder extending between said packer plate and the front end of said body for moving said packer plate fore-and-aft, a collection hopper at the front end of said body and opening through the side thereof for loading refuse into the hopper, said hopper communicating with said opening means, in said packer plate, a hopper plate movable rearwardly along the bottom surface of said hopper to remove refuse from the hopper, a second hydraulic cylinder extending between one of the walls of said body and said hopper plate for moving said hopper plate rearwardly, a sweep panel carried by said packer plate movable along a path between a retracted position forward of said packer plate and an extended position adjacent said opening means, said path being close to the rearward position of said hopper plate to sweep refuse therefrom into said body, a rigid support arm carried by said packer plate and extending fowardly therefrom, and a third hydraulic cylinder carried at one end by said support arm and at the other end by said sweep panel for moving said sweep panel along its path, whereby said packer and said sweep panel comprises a unit substantially spanning said body and being movable fore-and-aft by said first hydraulic cylinder to compress refuse therein.

26. A refuse collection vehicle in accordance with claim 25 wherein said second hydraulic cylinder is normally retracted to position said hopper plate toward the front of said hopper, and said third hydraulic cylinder is normally extended to position said sweep panel to close said opening means in said packer plate.

27. A refuse collection vehicle in accordance with claim 25 further comprising a hydraulic system for driving said cylinders, said hydraulic system including a sequential control system and an operating valve for energizing said sequential control system, said sequential control system including a first sequence valve for first moving said sweep panel to a retracted position toward the front of said body and then moving said hopper plate to scoop refuse from said hopper and a second sequence valve for first moving said sweep panel to a position adjacent said opening means to sweep refuse from said hopper plate into the body and then retracting said hopper plate to its initial position.

28. A refuse collection vehicle in accordance with claim 27 wherein said control valve automatically switches from said first sequence to said second sequence valve.

29. A refuse collection vehicle in accordance with claim 27 wherein said hydraulic system locks said sweep panel adjacent said opening means when said first hydraulic cylinder is energized, whereby said packer plate and sweep panel comprise a unit for packing refuse in said body.

30. A refuse collection vehicle comprising a refuse storage body, a refuse receiving hopper forming a part of said body, refuse packing means including opening means therethrough movable in said body to move and compress refuse therein, refuse moving means cooperatively associated with said hopper to remove refuse therefrom into said body through said opening means, at least a portion of said refuse moving means being movable to close said opening means and being movable with said packing means during compression of refuse within said body.

31. A refuse collection vehicle in accordance with claim 30 wherein said refuse packing means include refuse contacting portions arranged to distribute refuse throughout said body.

32. A refuse collection vehicle in accordance with claim 31 wherein said refuse moving means includes refuse contacting portions arranged to distribute refuse through said body.

33. A refuse collection vehicle in accordance with claim 30 wherein said opening means in said packing means is in communication with said hopper, said portion of said refuse moving means comprising a panel carried by said packing means and movable between a position adjacent said opening means and substantially closing same and a position spaced from said opening means.

34. A refuse collection vehicle in accordance with claim 33 wherein said refuse moving means further comprises a hopper plate movable in said hopper to move refuse therein to adjacent said opening means, said panel being movable adjacent said hopper plate to move the refuse through said opening means into said refuse body.

35. A refuse collection vehicle in accordance with claim 30 further comprising refuse loading opening means in one side of said body in communication with said hopper.

36. A refuse collection vehicle in accordance with claim 35 further comprising a spill shield carried by said body adjacent said loading opening means and cooperatively associated with said refuse moving means to close at least a portion of said loading opening means during movement of the refuse moving means.

37. A refuse collection vehicle in accordance with claim 33 wherein said panel is pivotally connected at the top of said opening means, said hopper being substantially semi-circular, said refuse moving means further comprising a hopper plate pivotally carried at one end by said body and movable along an arc through said hopper to scoop and lift refuse therefrom to a position adjacent said opening means, the path of said panel between said spaced position and said closed position being closely adjacent said hopper plate, to sweep refuse therefrom through said opening means in said packing means and into said refuse body.

* * * * *